US006317060B1

(12) United States Patent
Jones

(10) Patent No.: US 6,317,060 B1
(45) **Date of Patent: *Nov. 13, 2001**

(54) BASE STATION SYSTEM AND METHOD FOR MONITORING TRAVEL OF MOBILE VEHICLES AND COMMUNICATING NOTIFICATION MESSAGES

(75) Inventor: Martin Kelly Jones, Vancouver (CA)

(73) Assignee: Global Research Systems, Inc., Rome, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/516,577

(22) Filed: Mar. 1, 2000

Related U.S. Application Data

(60) Provisional application No. 60/122,482, filed on Mar. 1, 1999.

(51) Int. Cl.[7] ..... G08G 1/123

(52) U.S. Cl. ..... 340/994; 340/989; 340/993; 701/204

(58) Field of Search ..... 340/994, 982, 340/989, 990, 991, 995, 906, 907, 539, 993; 701/204, 205, 206, 207, 208, 302

(56) References Cited

U.S. PATENT DOCUMENTS

| | | | |
|---|---|---|---|
| Re. 35,920 | 10/1998 | Sorden et al. | 342/457 |
| 4,220,946 | 9/1980 | Henriot | 340/994 |
| 4,713,661 | 12/1987 | Boone et al. | 340/994 |
| 4,791,571 | 12/1988 | Takahashi et al. | 701/117 |
| 4,799,162 | 1/1989 | Shinkawa et al. | 701/117 |
| 4,804,937 | 2/1989 | Barbiaux et al. | 340/459 |
| 4,812,843 | 3/1989 | Champion, III et al. | 340/905 |
| 4,857,925 * | 8/1989 | Brubaker | 340/994 |

(List continued on next page.)

FOREIGN PATENT DOCUMENTS

| | | |
|---|---|---|
| 2 559 930 | 8/1985 | (FR) . |
| 2674355 | 9/1992 | (FR) . |
| 52066175 | 6/1977 | (JP) . |
| 63288400 | 11/1988 | (JP) . |

*Primary Examiner*—Benjamin C. Lee
(74) *Attorney, Agent, or Firm*—Thomas, Kayden, Horstemeyer & Risley, LLP

(57) ABSTRACT

A vehicle monitoring and notification system includes a route handler, a schedule monitor, and a communication handler. The schedule monitor determines when users should receive notification messages based on data that indicates when vehicles are expected to arrive at certain locations. The route handler communicates with vehicle control units on board vehicles to determine whether and how much any of the vehicles are off schedule. If any of the vehicles are off schedule, the route handler updates the data monitored by the schedule monitor to change when the schedule monitor determines that notification messages should be received by the users. Once the schedule monitor determines that a user should receive a notification message, the schedule monitor transmits a notification request to the communication handler. The communication handler then establishes communication with a communication device associated with the user and transmits a notification message to the user. Therefore, the user is warned of an impending arrival of a vehicle at a particular location.

23 Claims, 11 Drawing Sheets

U.S. PATENT DOCUMENTS

| | | | | |
|---|---|---|---|---|
| 4,956,777 | | 9/1990 | Cearley et al. | 401/24 |
| 5,006,847 | * | 4/1991 | Rush et al. | 340/994 |
| 5,014,206 | | 5/1991 | Scribner et al. | 701/207 |
| 5,068,656 | | 11/1991 | Sutherland | 340/989 |
| 5,122,959 | | 6/1992 | Nathanson et al. | 701/117 |
| 5,131,020 | | 7/1992 | Liebesny et al. | 455/427 |
| 5,168,451 | * | 12/1992 | Bolger | 701/117 |
| 5,218,629 | | 6/1993 | Dumond, Jr. et al. | 455/572 |
| 5,223,844 | | 6/1993 | Mansell et al. | 342/357.07 |
| 5,243,529 | * | 9/1993 | Kashiwazaki | 701/208 |
| 5,299,132 | | 3/1994 | Wortham | 455/457 |
| 5,351,194 | | 9/1994 | Ross et al. | 455/456 |
| 5,381,338 | | 1/1995 | Wysocki et al. | 701/207 |
| 5,400,020 | | 3/1995 | Jones | 340/994 |
| 5,440,489 | * | 8/1995 | Newman | 701/20 |
| 5,444,444 | | 8/1995 | Ross | 340/994 |
| 5,461,374 | | 10/1995 | Lewiner et al. | 340/994 |
| 5,483,234 | * | 1/1996 | Carreel | 340/994 |
| 5,483,454 | * | 1/1996 | Lewiner et al. | 701/200 |
| 5,493,295 | | 2/1996 | Lewiner et al. | 340/994 |
| 5,493,694 | | 2/1996 | Vlcek et al. | 455/521 |
| 5,515,421 | | 5/1996 | Sikand et al. | 379/88.21 |
| 5,519,621 | | 5/1996 | Wortham | 455/99 |
| 5,539,810 | | 7/1996 | Kennedy, III et al. | 379/88.25 |
| 5,544,225 | | 8/1996 | Kennedy, III et al. | 455/412 |
| 5,546,444 | | 8/1996 | Roach, Jr. et al. | 455/412 |
| 5,587,715 | | 12/1996 | Lewis | 342/357.03 |
| 5,594,650 | | 1/1997 | Shah et al. | 701/207 |
| 5,602,739 | | 2/1997 | Haagenstad et al. | 701/117 |
| 5,623,260 | | 4/1997 | Jones | 340/994 |
| 5,648,770 | | 7/1997 | Ross | 340/994 |
| 5,652,707 | | 7/1997 | Wortham | 455/456 |
| 5,657,010 | | 8/1997 | Jones | 340/994 |
| 5,668,543 | | 9/1997 | Jones | 340/994 |
| 5,673,305 | | 9/1997 | Ross | 455/577 |
| 5,719,771 | | 2/1998 | Buck et al. | 455/456 |
| 5,724,243 | | 3/1998 | Westerlage et al. | 455/456 |
| 5,736,940 | | 4/1998 | Burgener | 340/994 |
| 5,739,774 | | 4/1998 | Olandesi | 340/994 |
| 5,751,245 | | 5/1998 | Janky et al. | 342/357.07 |
| 5,760,742 | | 6/1998 | Branch et al. | 342/457 |
| 5,771,455 | | 6/1998 | Kennedy, III et al. | 455/456 |
| 5,808,565 | | 9/1998 | Matta et al. | 340/994 |
| 5,987,377 | * | 11/1999 | Westerlage et al. | 701/204 |
| 6,006,159 | | 12/1999 | Schmier et al. | 701/200 |
| 6,134,501 | | 10/2000 | Oumi | 701/209 |
| 6,137,425 | * | 10/2000 | Oster et al. | 340/994 |
| 6,178,378 | * | 1/2001 | Leibold | 701/202 |

* cited by examiner

81

| | TIME | Contact Information | Vechicle ID |
|---|---|---|---|
| Entry 1 | 6:30 | 1235670987 | 1112 |
| Entry 2 | 9:15 | 1235290945 | 2034 |
| Entry 3 | 12:45 | 1235467867 | 1390 |
| Entry 4 | 15:30 | 1234342313 | 0999 |

FIG. 6

BASE STATION SYSTEM AND METHOD FOR MONITORING TRAVEL OF MOBILE VEHICLES AND COMMUNICATING NOTIFICATION MESSAGES

CLAIM OF PRIORITY AND CROSS REFERENCE TO RELATED APPLICATIONS

This document claims priority to U.S. provisional patent application entitled "BASE STATION APPARATUS AND METHOD FOR MONITORING TRAVEL OF MOBILE VEHICLE," assigned Ser. No. 60/122,482 and filed on Mar. 1, 1999, which is incorporated herein by reference.

BACKGROUND OF THE INVENTION

1. Field of the Invention

The present invention generally relates to vehicle monitoring and messaging systems and, in particular, to a vehicle monitoring system and method capable of communicating a plurality of notification messages to warn users of impending arrivals of vehicles.

2. Related Art

U.S. Pat. No. 5,400,020, entitled "Advance Notification System and Method," which is incorporated herein by reference, describes a system and method for communicating notification messages to users to warn the users of impending arrivals of vehicles. In this regard, each vehicle associated with the system is equipped with a tracking sensor, which is used to determine the location of the vehicle. Location signals indicating the location of the vehicle as the vehicle travels are transmitted to a base station control unit, which monitors the travel of the vehicle. When the vehicle is within a predefined time or distance of a particular location, the base station control unit transmits a notification message to a user. Therefore, the user is warned of the impending arrival of the vehicle at the particular location.

However, the base station control unit may be used to monitor the travel of a large number of vehicles or may be used to warn a large number of users of impending arrivals of a vehicle or vehicles. Furthermore, servicing a large number of vehicles and/or users may result in the need to simultaneously transmit a large number of notification messages. Accordingly, the ability to efficiently process data for a large number of vehicles and/or users and to efficiently transmit a large number of notification messages is critical in many applications.

Thus, a heretofore unaddressed need exists in the industry for better systems, apparatuses, and methods for accurately and efficiently tracking and/or reporting the status of mobile vehicles as the vehicles travel.

SUMMARY OF THE INVENTION

The present invention overcomes many inadequacies and deficiencies of the prior art, as discussed hereinbefore. In general, the present invention provides an automated computer-based apparatus and method for monitoring travel of vehicles and for efficiently communicating notification messages to warn users of impending arrivals of the vehicles.

In a broad sense, the automated computer-based apparatus of the present invention includes a route handler, a schedule monitor, and a communication handler. The schedule monitor determines when users should receive notification messages based on data that indicates when vehicles are expected to arrive at certain locations. The route handler communicates with vehicle control units on board the vehicles to determine how much any of the vehicles are off schedule. If any of the vehicles are off schedule, the route handler updates the data monitored by the schedule monitor to change when the schedule monitor determines that the notification messages should be received by the users.

Once the schedule monitor determines that a user should receive a notification message, the schedule monitor transmits a notification request to the communication handler. The communication handler then establishes communication with a communication device associated with the user and transmits a notification message to the user. Therefore, the user is warned of an impending arrival of a vehicle at a particular location.

In accordance with another feature of the present invention, the route handler selects portions of the data that are associated with notification events expected to occur during a particular time period. During the particular time period, the schedule monitor monitors the selected data to determine whether any notification messages should be received by users during the particular time period.

In accordance with another feature of the present invention, the communication handler stores the notification request and determines a number of notification requests stored by the communication handler. The communication handler then compares this number to a number of notification requests stored by another communication handler and transmits the notification request to the other communication handler if the difference in the two numbers exceeds a predefined threshold.

Other features and advantages of the present invention will become apparent to one skilled in the art upon examination of the following detailed description, when read in conjunction with the accompanying drawings. It is intended that all such features and advantages be included herein within the teachings of the present invention, as set forth herein and as sought to be protected by the claims.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

FIG. 6 is a schematic illustrating an exemplary list of notification events generated by the route handler of FIG. 5.

DETAILED DESCRIPTION OF THE INVENTION

Figure 1:
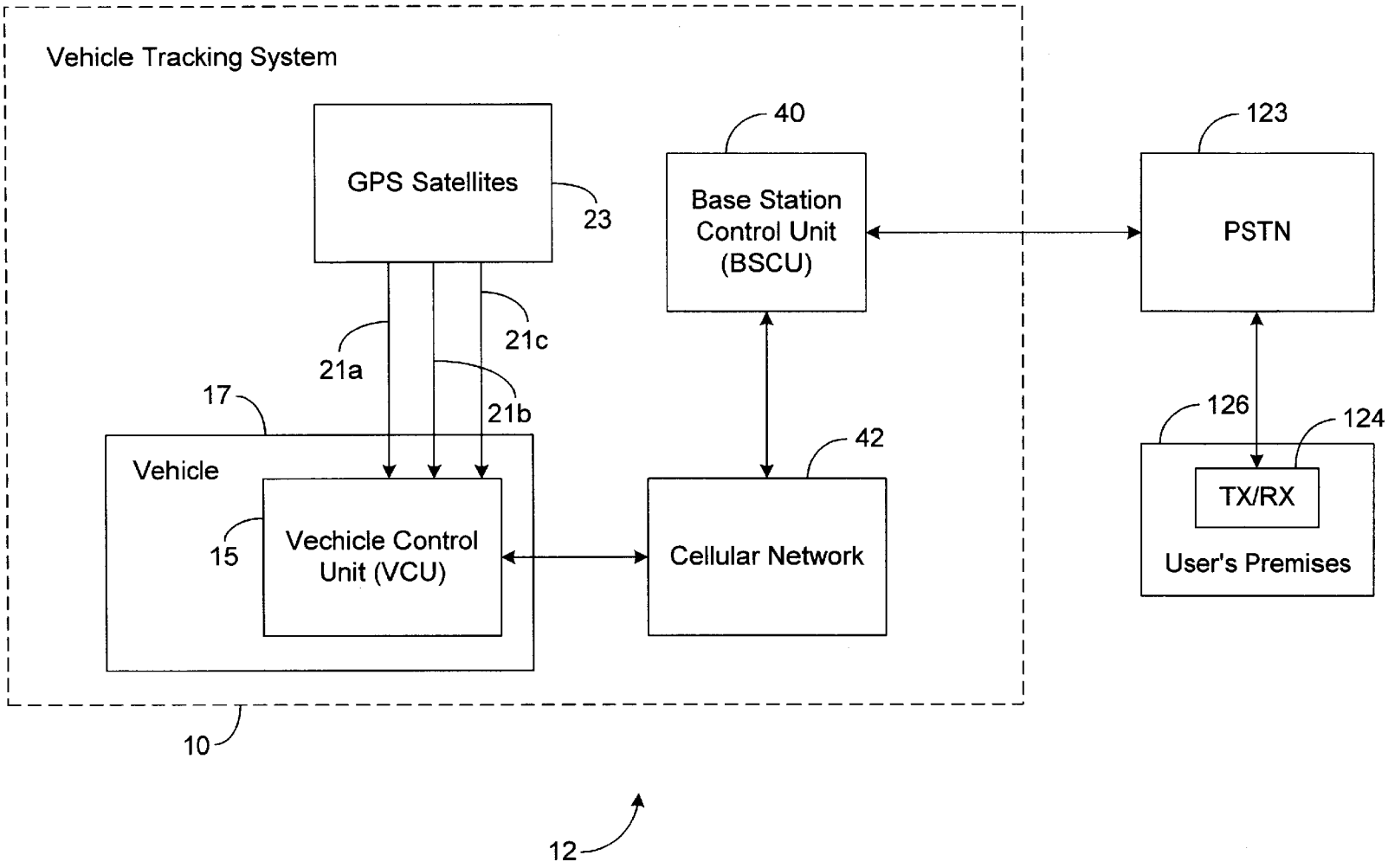
FIG. 1 is a block diagram illustrating a vehicle tracking system employed within the context of an advance notification system in accordance with the present invention.

FIG. 1 depicts an automated vehicle tracking system 10 illustrating the principles of the present invention. As shown by FIG. 1, the vehicle tracking system 10 is preferably employed within the context of an automated advance notification system 12 that automatically provides advance notice of impending arrivals of vehicles at destinations or other locations.

As depicted in FIG. 1, a vehicle control unit (VCU) 15 is disposed on a mobile vehicle 17, which is capable of transporting the VCU 15 over various distances. U.S. patent application entitled "System and Method for an Advance Notification System for Monitoring and Reporting Proximity of a Vehicle," assigned Ser. No. 09/163,958, and filed on Sep. 30, 1998, which is incorporated herein by reference, describes an exemplary VCU 15 that may be used to implement the principles of the present invention.

Preferably, the vehicle 17 is a delivery vehicle for delivering items to a destination or for picking up items at a destination. Note that items can include many various types of packages or goods to be delivered or picked up. Furthermore, items can also include persons to be picked up or delivered, such as when a bus picks up and/or delivers passengers at different bus stops. Preferably, the vehicle 17 travels along a predetermined route in making its deliveries, and the vehicle 17 may make numerous stops along its route in order to deliver or pick up different items at different locations.

Vehicle Control Unit

Figure 2:
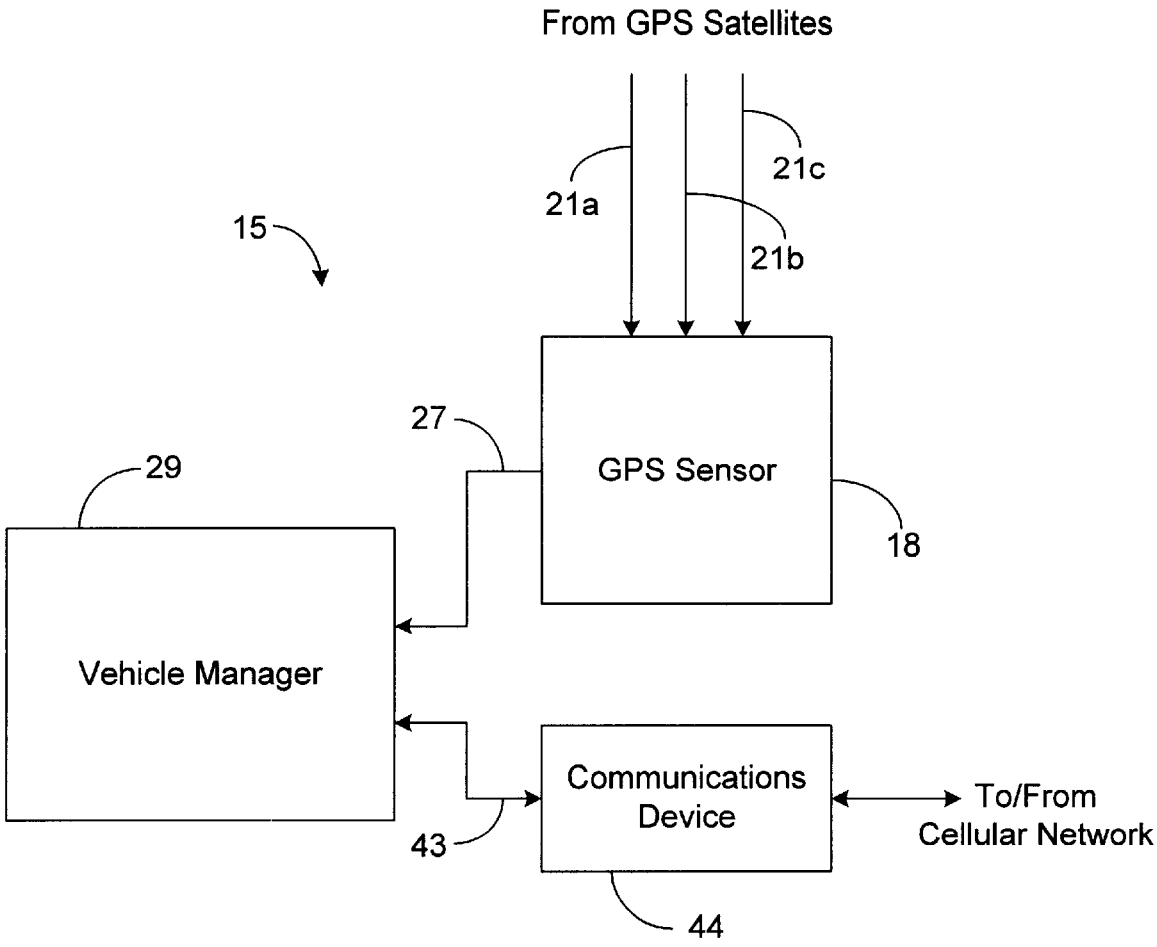
FIG. 2 is a block diagram illustrating an implementation of the vehicle control unit of FIG. 1 in accordance with the present invention.

A more detailed view of the VCU 15 is depicted in FIG. 2. A sensor 18 within VCU 15 is configured to determine the location of the sensor 18 relative to a predetermined reference point. Preferably, sensor 18 is a global positioning system (GPS) sensor, although other types of positioning systems and/or sensors are also possible. For example, other types of sensors 18 that may be used to implement the principles of the present invention include, but are not limited to, an odometer or sensors associated with Glonass, Loran, Shoran, Decca, or Tacan. The GPS sensor 18 is configured to receive signals 21*a*–21*c* from a plurality of GPS satellites 23, and as known in the art, sensor 18 is designed to analyze signals 21*a*–21*c* to determine the sensor's location or coordinate values relative to a predetermined reference point.

For example, in the foregoing embodiment where sensor 18 is a GPS sensor, the sensor 18 determines the sensor's location values relative to the Earth's zero degree latitude and zero degree longitude reference point, which is located at the intersection of the Equator and the Prime Meridian. U.S. Pat. No. 5,781,156 entitled "GPS Receiver and Method for Processing GPS Signals" and filed on Apr. 23, 1997 by Krasner, which is incorporated herein by reference, discusses the processing of GPS signals 21*a*–21*c* received from GPS satellites 23 in order to determine the sensor's location values. Since the sensor 18 is located on or within the vehicle 17, the location values determined by the sensor 18 are assumed to match the location values of the vehicle 17 and the VCU 15.

It should be noted that the term "location value" shall be defined herein to mean any value or set of values that may be used to determine a location of a point on the Earth or within the Earth's atmosphere. This value may be a distance value, a coordinate value (i.e., grid value), polar value, vector value, or any other type of value or values known in the art for indicating locations of points.

Sensor 18 is designed to periodically transmit a signal 27 to vehicle manager 29 indicating the vehicle's current location values. Vehicle manager 29 is configured to receive signal 27 and to monitor the location of the vehicle 17 over time by processing multiple signals 27. The vehicle manager 29 can be implemented in software, hardware, or a combination thereof. Preferably, as illustrated by way of example in FIG. 3, the vehicle manager 29 of the present invention along with its associated methodology is implemented in software and stored in computer memory 30 of a computer system 31.

Note that the vehicle manager 29 can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (magnetic), a read-only memory (ROM) (magnetic), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory. As an example, the vehicle manager 29 may be magnetically stored and transported on a conventional portable computer diskette.

Figure 3:
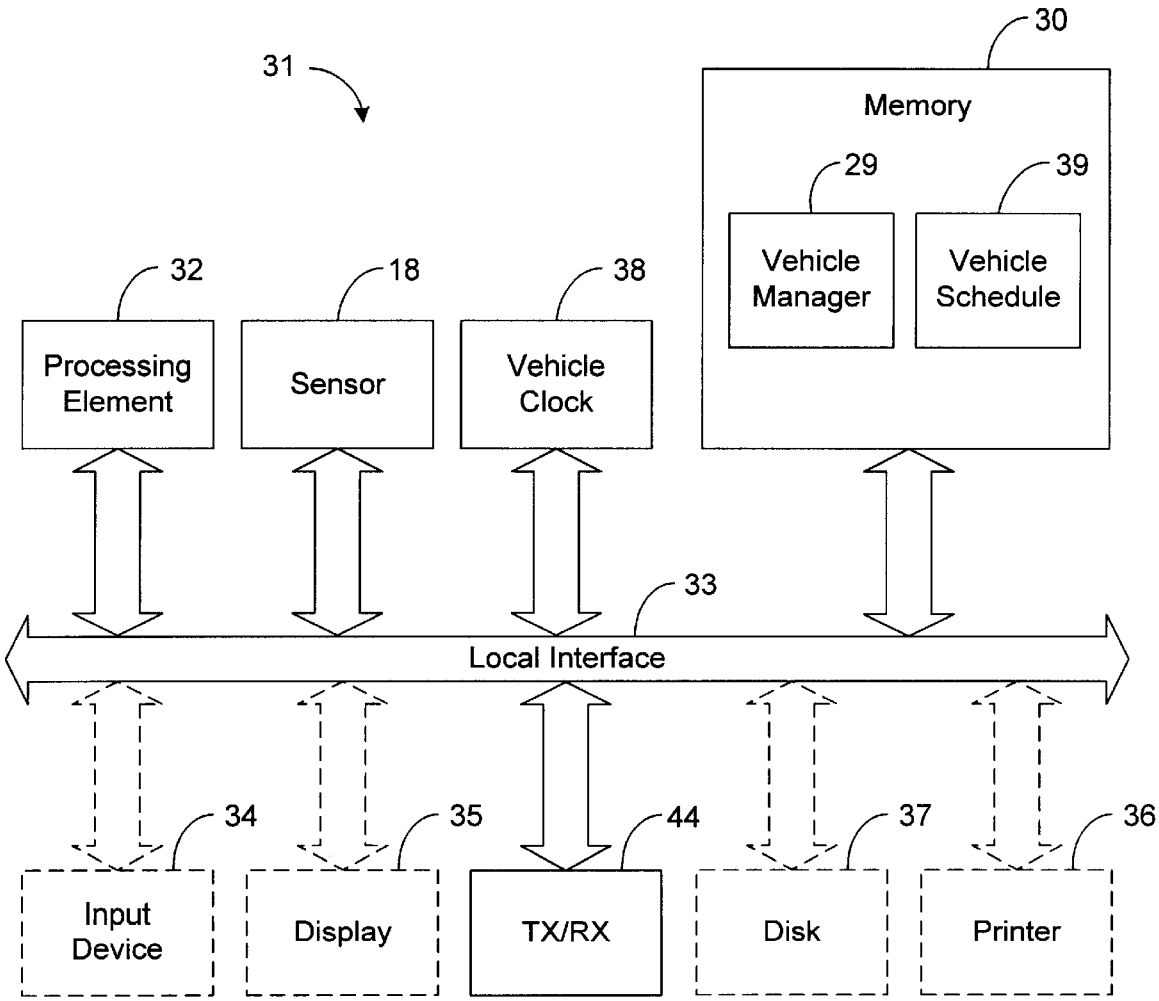
FIG. 3 is a block diagram illustrating a computer implementing the functionality of the vehicle control unit of FIG. 2 in accordance with the present invention.

The preferred embodiment of the computer system 31 of FIG. 3 comprises one or more conventional processing elements 32, such as a digital signal processor (DSP), that communicate to and drive the other elements within the system 31 via a local interface 33, which can include one or more buses. Furthermore, an input device 34, for example, a keyboard or a mouse, can be used to input data from a user of the system 31, and screen display 35 or a printer 36 can be used to output data to the user. A disk storage mechanism 37 can be connected to the local interface 33 to transfer data to and from a nonvolatile disk (e.g., magnetic, optical, etc.). Furthermore, a vehicle clock 38 may be connected to the computer system 31 so that components of the system 31 may utilize data from the clock 38 to determine time through conventional techniques. It should be noted that input device 34, display 35, printer 36, and disk 37 are optional and are not necessarily a part of the preferred embodiment.

The vehicle manager 29 is preferably configured to maintain a predefined schedule 39, referred to herein as the "vehicle schedule 39," within memory 30. The predefined vehicle schedule 39 corresponds with a route of travel for the vehicle 17. In this regard, the predefined vehicle schedule 39 stored in memory 30 includes data defining locations or "checkpoints" along the vehicle's intended route of travel. Furthermore, each checkpoint is associated with a particular time value indicating when the vehicle 17 is expected to pass the associated checkpoint. Each checkpoint along with its associated time value may define an entry in the vehicle schedule 39.

Preferably, the time value associated with a checkpoint corresponds to a time of day that the vehicle 17 is expected to pass the checkpoint. For example, the time value associated with a checkpoint may define the hour and minute that the vehicle 17 is expected to pass the checkpoint. Consequently, when the vehicle 17 reaches the location defined by the checkpoint, the time of day, as defined by vehicle clock 38, can be compared with the time value in the schedule 39 associated with the checkpoint to determine whether the vehicle 17 is early, late, or on time. It should be noted that other data and other methodologies, such as the those disclosed in U.S. Pat. No. 5,400,020, for example, may be employed to determine whether or not the vehicle 17 is on schedule, without departing from the principles of the present invention.

As the vehicle 17 travels along its route, the vehicle manager 29 determines when the vehicle 17 passes a checkpoint by comparing the data received from sensor 18 with the checkpoint data stored in vehicle schedule 39. When the vehicle manager 29 determines that a checkpoint has been passed, the vehicle manager 29 is configured to determine a time value indicating the time of day by analyzing vehicle clock 38, and the vehicle manager 29 is configured to compare this time value with the time value in the schedule 39 associated with the checkpoint.

The vehicle 17 is considered to be off schedule if the value for the time of day from clock 38 differs from the time value in schedule 39 by a predetermined amount. Otherwise the vehicle 17 is considered to be on schedule. For example, assume that the vehicle 17 is to be considered off schedule if the vehicle 17 is early or late by more than two minutes and assume that the vehicle 17 is scheduled to pass a checkpoint at 6:30 a.m. If the vehicle 17 passes the checkpoint between 6:28 a.m. and 6:32 a.m., the vehicle 17 is on schedule. If the vehicle 17 passes the checkpoint before 6:28 a.m., the vehicle is off schedule and is early. If the vehicle 17 passes the checkpoint after 6:32 a.m., the vehicle 17 is off schedule and is late.

If the vehicle manager 29 determines that the vehicle 17 is off schedule, the vehicle manager 29 is configured to transmit a status message to a base station control unit (BSCU) 40 (FIG. 1) indicating how much the vehicle is off schedule, and the vehicle manager 29 is also configured to update the entries in the schedule 39. For example, assume that the vehicle 17 passes the aforementioned checkpoint at 6:25 a.m. In this example, the vehicle 17 is off schedule and five minutes early. Therefore, the vehicle manager 29 transmits a status message to BSCU 40 via cellular network 42 indicating that the vehicle 17 is five minutes early and decreases the expected times stored in the schedule 39 by five minutes. As a result, the schedule 39 is adjusted to account for the vehicle's earliness, and the vehicle 17 will not be deemed off schedule when the vehicle 17 passes the other checkpoints, provided that the rate of travel of the vehicle 17 continues as expected for the remainder of the route. Similarly, if the vehicle 17 passes the aforementioned checkpoint at 6:35 a.m., then the vehicle manager 29 is configured to transmit a status message indicating that the vehicle 17 is five minutes late and is configured to increase the times stored in the schedule 39 by five minutes.

It should be noted that updating the schedule 39 is not necessary in implementing the present invention. However, if the vehicle 17 is early or late at one checkpoint, the vehicle 17 will likely be respectively early or late at other checkpoints causing the vehicle manager 29 to make an off schedule determination and to transmit a status message at each of the remaining checkpoints in the route. By updating the times in schedule 39, the number of status messages transmitted to the BSCU 40 may be reduced in monitoring the travel of the vehicle 17.

It should be further noted that the status message transmitted by VCU 15 may be communicated via any suitable technique and that utilization of the cellular network 42 is not necessary. In this regard, other types of networks may be used to communicate the status message, or the status message may be communicated directly to the base station control unit 40 without the use of any type of communication network. For example, the status message may be communicated via short wave radio.

Base Station Control Unit

Figure 4:
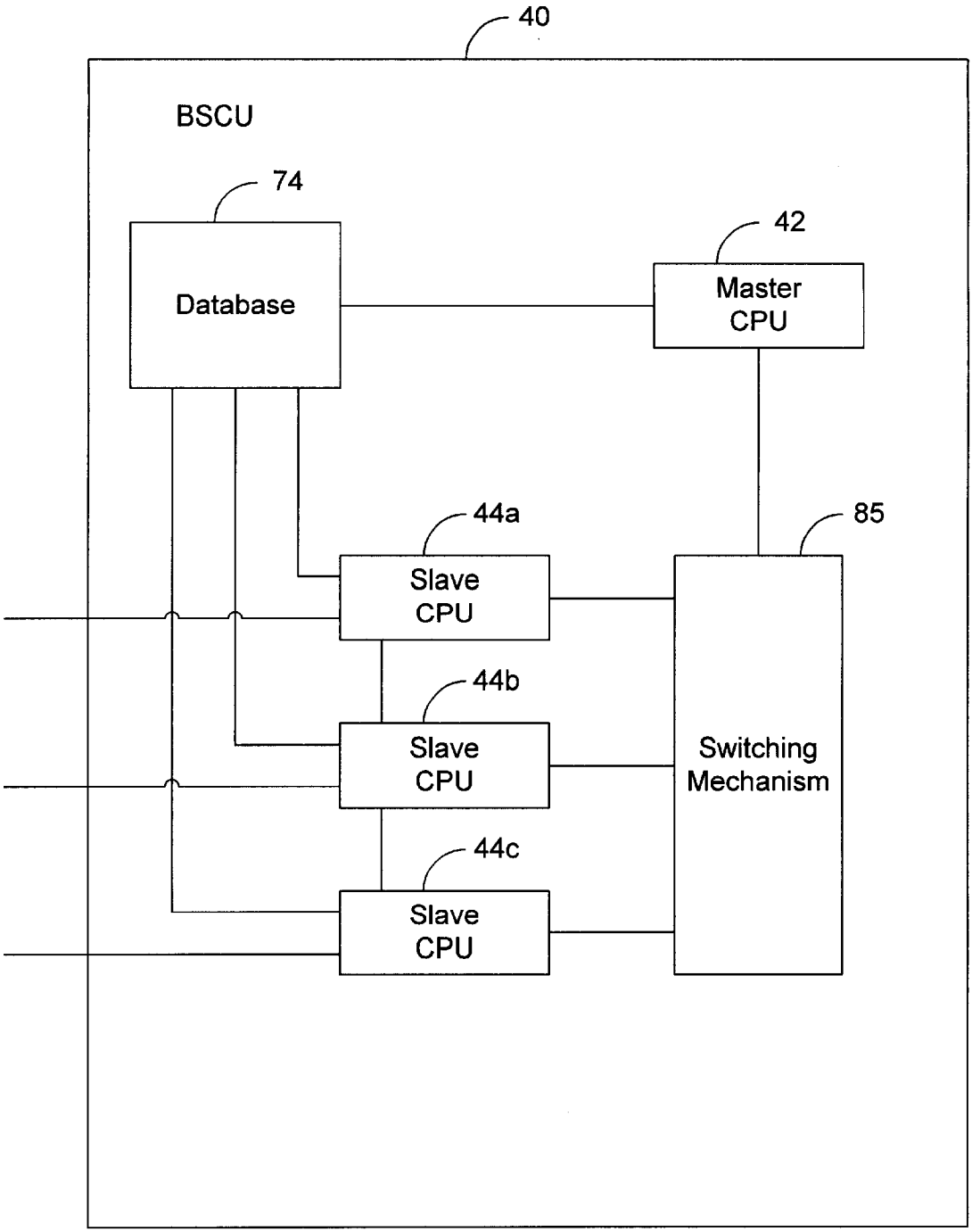
FIG. 4 is a block diagram illustrating an implementation of the base station control unit of FIG. 1 in accordance with the present invention.
Figure 5:
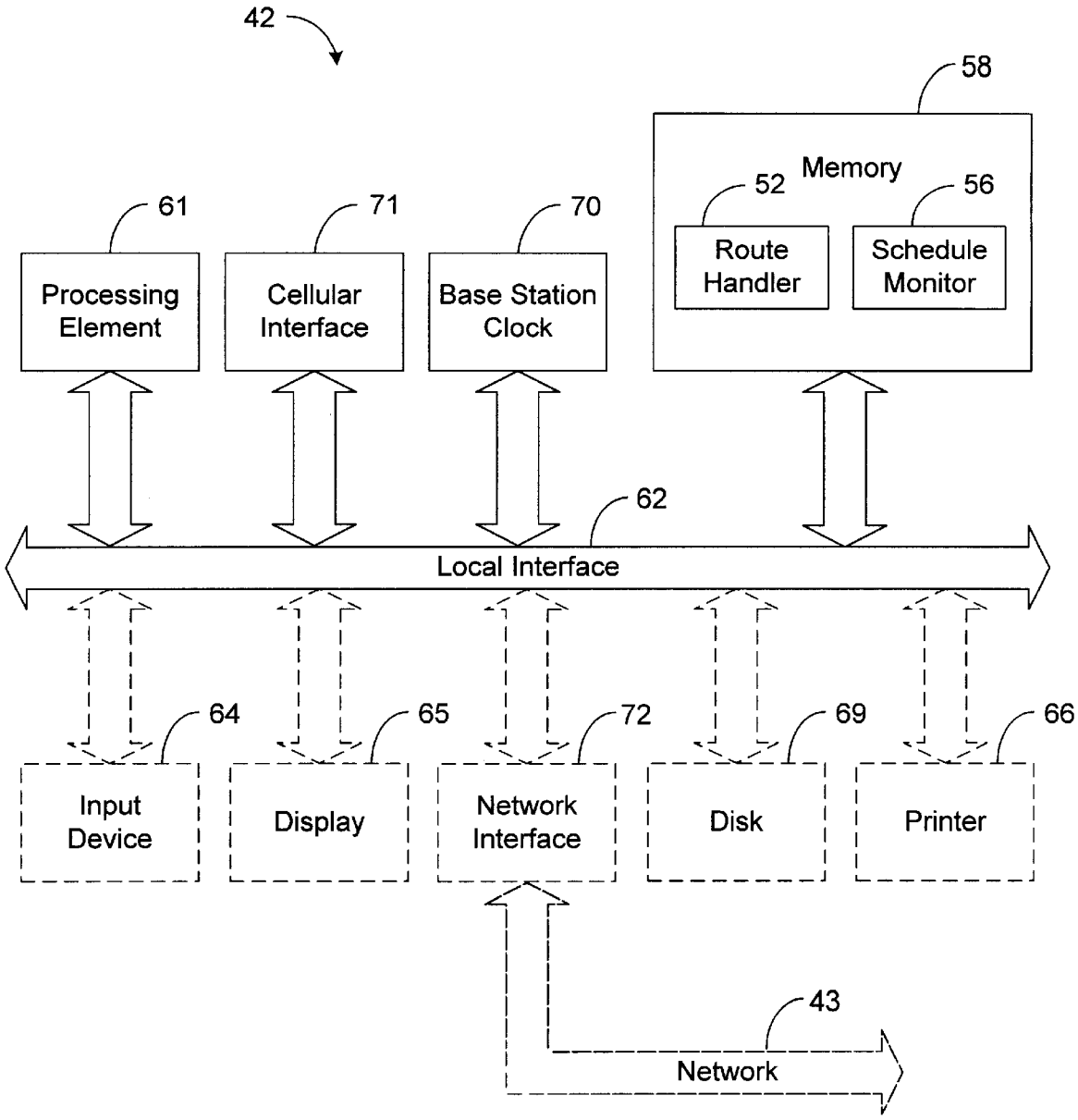
FIG. 5 is a block diagram illustrating a computer implementing the functionality of the master computer depicted in FIG. 4 in accordance with the present invention.

Referring to FIG. 4, the base station control unit (BSCU) 40 preferably comprises a master computer system 42 that controls one or more slave computer systems 44*a*, 44*b*, and 44*c*. Referring to FIG. 5, the master computer system 42 includes a route handler 52 and a schedule monitor 56. The route handler 52 and schedule monitor 56, which will be described in further detail hereafter, can be implemented in software, hardware, or a combination thereof. Preferably, as illustrated by way of example in FIG. 5, the route handler 52 and schedule monitor 56 of the present invention along with their associated methodology are implemented in software and stored in memory 58.

Further shown by FIG. 5, the computer system 42 may include one or more processing elements 61, such as a DSP, that communicate to and drive the other elements within the system 42 via a local interface 62, which may include one or more buses. Furthermore, an input device 64, for example, a keyboard or a mouse, can be used to input data from a user of the system 42, and screen display 65 or a printer 66 can be used to output data to the user. A disk storage mechanism 69 can be connected to the local interface 62 to transfer data to and from a nonvolatile disk (e.g., magnetic, optical, etc.). Furthermore, a base station clock 70 may be connected to the computer system 42 so that components of the system 42 may utilize data from the clock 70 to determine time through conventional techniques. The system 42 may also be connected to a cellular interface 71, or other type of suitable interface, for communicating with VCU 15. It may also be desirable for computer system 42 to include a network interface 72 that allows the system 42 to exchange data with a network 73. It should be noted that input device 64, display 65, printer 66, disk 69, network interface 72, and network 73 are optional and are not necessarily a part of the preferred embodiment.

Referring again to FIG. 4, the database 74 shown by FIG. 4 preferably stores data defining the routes of one or more vehicles 17. For example, the database 74 may include entries that are correlated with a vehicle 17 of the system 10, wherein each entry includes sufficient data to define a checkpoint that may be used to monitor the travel of the vehicle 17. The checkpoints defined in the database 74 for a particular vehicle 17 are preferably the same checkpoints defined in vehicle schedule 39 for the particular vehicle 17. Furthermore, the entry may also include data to indicate the time of day that the vehicle 17 is expected to reach the checkpoint defined by the entry. Therefore, the database 74 includes sufficient data to define the checkpoints used to monitor the vehicles 17 associated with the system 10 and the times that the vehicles 17 should respectively pass the checkpoints.

Preferably, the database 74 also includes data indicating when different users are to be notified of an impending arrival of at least one of the vehicles 17 associated with the system 10. For example, the database 74 may include data indicating that a user should be notified a certain amount of time before or after a particular vehicle 17 passes a particular checkpoint. Therefore, at any time, the database 74 can be queried to determine which checkpoints are to be passed by a particular vehicle 17 and when the particular vehicle 17 is expected to pass each of the checkpoints. The database 74 also can be queried to determine when users are to be notified of the particular vehicle's impending arrival. To facilitate querying of the database, the entries of the database 74 may be keyed by vehicle numbers used to identify the vehicles associated with the system 10.

To illustrate the configuration and use of the database 74, assume that a user would like to be notified when a particular vehicle 17 is two minutes from a particular location, such as the user's house or a scheduled vehicle stop. Assume further that the vehicle 17 is scheduled to pass a checkpoint every five minutes after starting its route and that the particular location is expected to be reached seventeen minutes after the vehicle 17 starts its route. In this scenario, the database 74 should include data that defines each of the checkpoints along the vehicle's route and that indicates the time that the vehicle 17 is expected to pass each of the checkpoints. The database 74 should also indicate that the individual is to be notified when the vehicle 17 passes the third checkpoint, since the vehicle 17 is expected to pass the third checkpoint fifteen minutes into the route (i.e., two minutes before the vehicle 17 is expected to reach the particular location).

The database 74 also preferably includes sufficient information to enable the individual to be automatically notified once a determination is made that the user should be notified. For example, the database 74 may include the individual's telephone number, pager number, e-mail address, or other type of contact information, depending on the methodology used to notify the individual.

The route handler 52 (FIG. 5) is configured to query the database 74 to build a list of notification events that are expected to occur during a specified time period. A "notification event" is the generation of a notification message to be transmitted to a user to notify the user of an impending arrival of a vehicle 17 associated with the system 10. For example, the route handler 52 may query the database 74 at the beginning of a day to determine each notification event that should occur during the course of the day, and the route handler 52 then builds a list of these events. The list should not only indicate what notification events are to occur but also should indicate at what time each notification event is expected to occur. The list may also include contact information (e.g., telephone numbers, pager numbers, e-mail addresses etc.) to facilitate the process of contacting the users associated with the notification events in the list.

FIG. 6 shows an exemplary list 81 that may be produced by the route handler 52. The list 81 depicts four entries, although any number of entries may be included in the list 81. Each entry of the list 81 is associated with a respective notification event and indicates: (1) the time at which the respective notification event is expected to occur, (2) the contact information (e.g., telephone number, pager number, e-mail address etc.) associated with the particular user, and (3) a vehicle number identifying the particular vehicle 17 associated with the notification event. For example, assume that "entry 1" is associated with a notification event for a user that would like to be notified when a particular vehicle (vehicle number "1112") is five minutes from a particular location. Based on the information stored in database 74, assume that the route handler 52 determines that the notification event should occur at 6:30 a.m. (five minutes before the particular vehicle 17 is scheduled to arrive at the particular location). As a result, "entry 1" of the list 81 indicates that the notification event associated with the entry is to occur at 6:30 a.m. "Entry 1" also provides the user's contact information and the vehicle number ("1112") of the vehicle 17 that is to arrive at the particular location. Each of the other entries can be similarly configured based on the information associated with the notification events associated with the other entries. Once the route handler 52 has defined the list 81, the route handler 52 transmits the list 81 to schedule monitor 56.

When the BSCU 40 receives a status message from one of the VCUs 15 indicating that one of the vehicles 17 is early or late, the route handler 52 transmits an update request based on the received status message. In response to the update request, the schedule monitor 56 is designed to update the list 81, if the list 81 includes an entry associated with a notification event pertaining to the one vehicle 17.

For example, assume that the route handler 52 receives a status message indicating that the vehicle 17 associated with "entry 1" (i.e., vehicle number "1112") is seven minutes late. In response, the route handler 52 transmits an update request to schedule monitor 56. The update request preferably includes information indicating which vehicle 17 is off schedule and how much the vehicle 17 is off schedule. Based on this update request, the schedule monitor 56 determines that the vehicle 17 associated with the update request (i.e., vehicle number "1112") is seven minutes late. The schedule monitor 56 is designed to traverse the list 81 to identify each entry associated with the vehicle number "1112" and is configured to increase the time values stored in the identified entries by seven minutes to account for the tardiness of vehicle number "1112." Therefore, in the list 81 depicted by FIG. 6, the schedule monitor 56 changes the time value in "entry 1" from "6:30" to "6:37." As a result, the notification event associated with "entry 1" should not occur until 6:37 a.m.

Upon receiving a status message, the route handler 52 is also designed to update the database 74. Therefore, in the example described hereinbefore, the route handler 52 is designed to input data into the database 74 indicating that vehicle number "1112" is seven minutes late. As a result, the database 74 can be consulted at any time to determine not only the scheduled route of any vehicle 17 but also to determine the status of the vehicle 17 as the vehicle 17 is traveling its route. In this regard, if the database 74 does not indicate that a particular vehicle 17 is early or late, then it can be assumed that the vehicle 17 should arrive at its future checkpoints on schedule. However, if the database 74 indicates that the vehicle 17 is early or late, then it can be assumed that the vehicle 17 will arrive at its future checkpoints off schedule by the amount indicated by the database 74.

The schedule monitor 56 is configured to periodically scan the list 81 to determine if a notification event should occur (i.e., if a notification message should be transmitted to a user). In this regard, when the time of the day, as determined from base station clock 70, corresponds to (e.g., matches) the time indicated by one of the entries in the list 81, the schedule monitor 56 determines that the notification event associated with the corresponding entry should occur. Therefore, to initiate the occurrence of the notification event, the schedule monitor 56 is designed to transmit a notification request to one of the slave computers 44*a*–44*c*, which transmits a notification message in response to the notification request, as will be described in more detail hereinbelow.

As shown by FIG. 4, a switching mechanism 85, such as an etherswitch, for example, is used to route the notification request to the appropriate slave computer 44*a*–44*c*. In an attempt to balance the workload of the slave computers 44*a*–44*c*, the schedule monitor 56 preferably selects one of the slave mechanisms 44*a*–44*c* to process the notification request based on the number of notification requests previously transmitted to each slave computer 44*a*–44*c* within a specified time period. For example, the schedule monitor 56 could be configured to transmit the notification message to the slave computer 44*a*–44*c* that has received the least number of notification requests in the last five minutes. As a result, the workload of the slave computers 44*a*–44*c* is not likely to become disproportionately high for any one of the slave computers 44*a*–44*c*.

Figure 7:
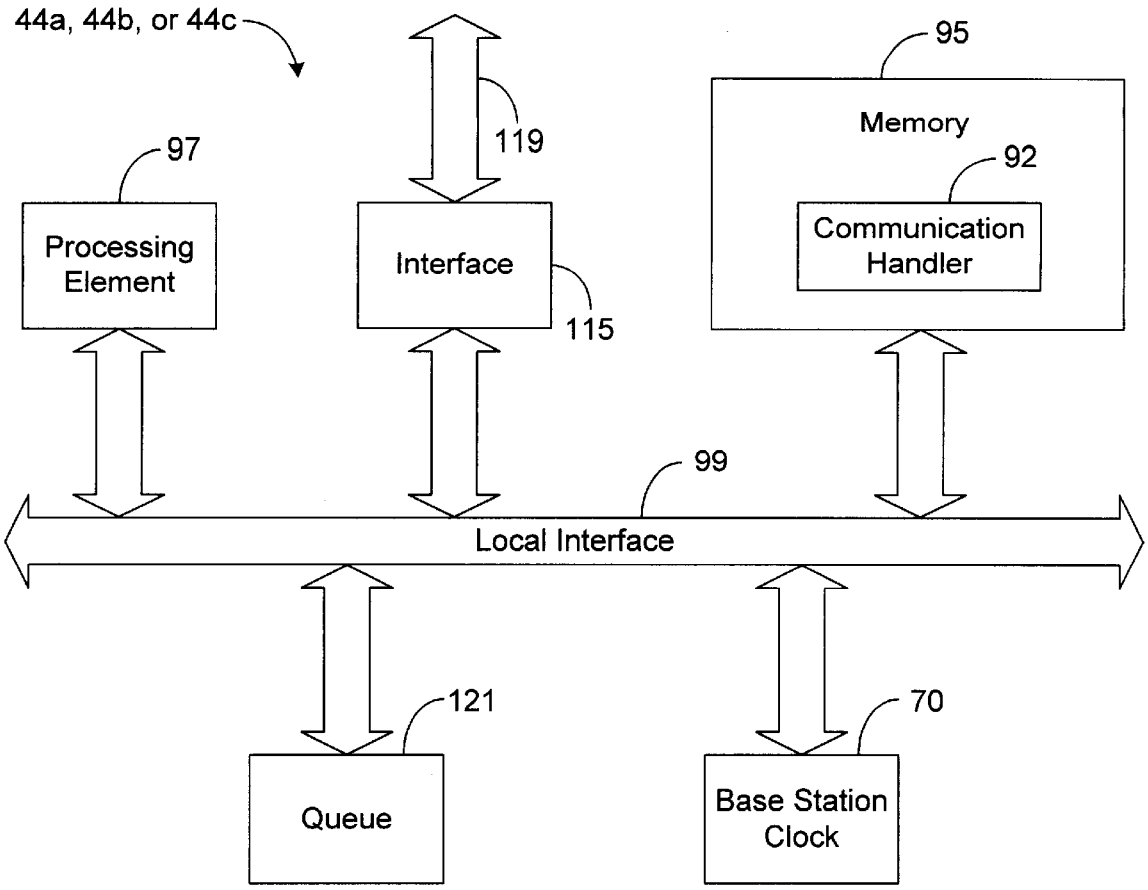
FIG. 7 is a block diagram illustrating a computer implementing the functionality of the slave computers depicted in FIG. 4 in accordance with the present invention.

As shown by FIG. 7, each of the slave computers 44*a*–44*c* includes a communication handler 92 configured to process each notification request received by the computer 44*a*–44*c*. The communication handler 92 may be implemented in software, hardware, or a combination thereof. Preferably, as depicted by FIG. 7, the communication handler 92 is implemented in software and stored in memory 95.

Further shown by FIG. 7, each slave computer system 44*a*–44*c* may include one or more processing elements 97, such as a DSP, that communicate to and drive the other elements within the system 44*a*–44*c* via a local interface 99, which may include one or more buses. Furthermore, the base station clock 70 may be connected to each computer system 44*a*–44*c* so that components of the system 44*a*–44*c* may utilize data from the clock 70 to determine time through conventional techniques. Each slave computer 44*a*–44*c* preferably includes an interface 115, such as a telephone interface, for example, coupled to a plurality of communication connections 119 that enables the communication handler 92 to transmit the notification messages across the connections 119. As an example, the interface 115 may be coupled to a T1 trunk or a plurality of T1 trunks that, as known in the art, are capable of placing up to twenty-four telephone calls each.

Figure 8:
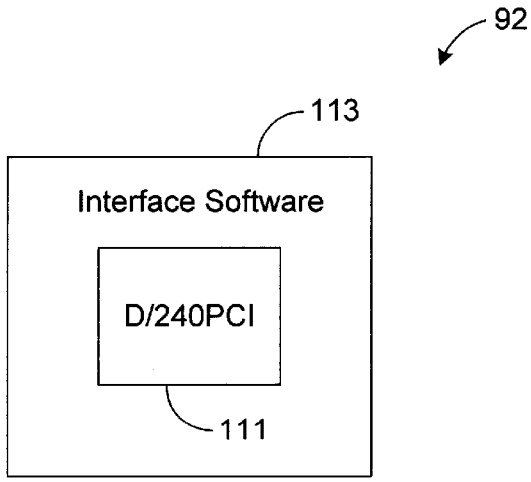
FIG. 8 is a block diagram illustrating a more detailed view of the communication handler depicted in FIG. 7.

The communication handler 92 is preferably capable of processing multiple notification requests and of simultaneously communicating multiple notification messages to users to warn the users of impending arrivals of vehicles 17. For example, in one embodiment, the communication handler 92 is implemented by a D/240PCI card 111 manufactured by Dialogic Corp., as shown by FIG. 8. Other software 113 may be implemented to interface the notification messages with the Dialogic card. This other software 113 may include Visual Voice software, which is a well known set of software commonly used to interface data with the Dialogic card 111.

As shown by FIG. 1, the notification messages may be routed to one or more users via a communication network, such as the publicly switched telephone network (PSTN) 123. In this regard, the network 123 routes each notification message transmitted by a communication handler 92 to a communication device 124, such as a telephone, for example, at a premises 126 of a user that is to receive the notification message. Upon receiving the notification message from network 123, the communication device 124 communicates the notification message to the user. It should be noted that the notification messages do not necessarily have to be communicated via telephone calls and that the communications device 124 may be any device capable of communicating a notification message. For example, the communications device 124 may be pager in one embodiment. In another embodiment, the communication handler 92 transmits a notification message to the device 124 via the Internet. For example, the communication handler 92 may transmit an e-mail message to the device 124, which in this example is a computer capable of reading the message and displaying the message to the user.

If a notification request cannot be immediately serviced by the communication handler 92, then the communication handler 92 is designed to store the notification request into a queue 121. The communication handler 92 then services the notification requests stored in the queue 121 on a first in, first out (FIFO) basis. Therefore, the communication handler 92 of each system 44*a*–44*c* services the notification requests in the order in which they were received by the communication handler 92.

As stated hereinbefore, each notification request is generated in response to a determination that a user should be warned of an impending arrival of a particular vehicle 17 at a particular location. Therefore, each notification request preferably includes contact information to enable the communication handler 92 to send a notification message to the particular user associated with the notification request or includes other information to enable the communication handler 92 to retrieve such contact information from the database 74. As a result, the communication handler 92 is configured to utilize contact information included in the notification request or stored in the database 74 to transmit a notification request to the user associated with the notification request.

It should be noted that it is possible for the notification message to be user specific. For example, the message may include the phrase "Vehicle number 1112 is five minutes from your vehicle stop." To enable such a message, the vehicle number and the time from the user's stop may be included in the notification request. Therefore, each entry in the list 81 may include, in addition to the information shown in FIG. 6, the amount of time that the vehicle 17 is from the user's selected destination when the notification event associated with the entry is expected to occur.

Furthermore, since there may be a delay between generating a notification request and in servicing the notification request, the communication handler 92 may be designed to query the database 74 to update the notification message before transmission. For example, if the notification request is generated when the vehicle 17 is five minutes from a user's selected destination and if the notification message is transmitted two minutes later, the communication handler 92 can be designed to query the database 74 based on the information provided in the notification request and determine that two minutes have elapsed since the notification request was generated. Therefore, the communication handler 92 may modify the message to include the phrase "Vehicle 1112 is three minutes from your vehicle stop."

It should be further noted that the list 81 is not a necessary feature of the present invention. In this regard, the database 74 can be repeatedly searched to determine when to generate notification requests. However, repeatedly searching the database 74 could result in the unnecessary processing of a vast amount of data, depending on the amount of data and entries stored in database 74. Utilization of the list 81 enables a much smaller amount of data to be searched in identifying whether notification requests should be generated.

Furthermore, it is not necessary for the communication handlers 92 to be implemented by slave computers 44*a*–44*c*. For example, it may be possible to implement the route handler 52, the schedule monitor 56, and the communication handlers 92 in a single computer system, such as system 42. In addition, the present invention has been described as using three communication handlers 92 for the purposes of illustration only, and any number of communication handlers 92 (i.e., one or more) may be utilized by the system 10.

In addition, it is possible to use the contents of the database 74 to create a web page indicating the status of the vehicles 17 associated with the system 10. Therefore, users can access the web page via the Internet or some other suitable communication network to determine whether a particular vehicle 17 is on or off schedule and how much a particular vehicle may be off schedule.

Furthermore, as shown by FIG. 4, the slave computers 44*a*–44*c* can be connected to one another and can be configured to reallocate notification requests. For example, the communication handlers 92 in the slave computers 44*a*–44*c* can be configured to communicate to one another how many notification requests are currently queued by each of the communication handlers 92. If the difference in the number of notification requests queued by one communication handler 92 and the number of notification requests queued by another communication handler 92 exceeds a predetermined threshold, then the communication handler 92 having the higher number of queued notification requests preferably transmits one or more of the queued notification requests to the other communication handler 92. Therefore, the occurrence of one communication handler 92 having a disproportionately high number of queued notification requests should be prevented.

It should be noted that there are many alternative embodiments that may be implemented to reallocate the notification requests without departing from the principles of the present invention. For example, in one embodiment, a first communication handler 92 may be designed to communicate a reallocation request to one or more of the other communication handlers 92 when the number of notification requests queued by the first communication handler falls below a predetermined threshold. In response to the reallocation request, at least one of the other communication handlers 92 transmits one or more of its queued notification requests to the first communication handler 92, which services the notification request. Other variations for reallocating the notification requests are possible.

In other embodiments, it may be possible for the VCU 15 to transmit notification requests directly to the communication device 124 at the user's premises 126. Such a system is fully described in U.S. Pat. No. 5,444,444 entitled "Apparatus and Method of Notifying a Recipient of an Unscheduled Delivery" and filed on Sep. 16, 1994, by Ross, which is incorporated herein by reference.

Alternative Embodiments

It should be noted that there are many alternative embodiments for implementing the vehicle tracking system 10. For example, in one alternative embodiment, portions of the schedule monitor 56 are implemented in each of the slave computers 44*a*–44*c*. When implemented in software, the schedule monitor 56 in each slave computer 44*a*–44*c* may be stored in the memory 95 of the slave computer 44*a*–44*c*.

In this example, a list 81 of notification events is created by the route handler 52 in the master computer 42, as described hereinabove. However, portions (e.g., entries) of the list 81 are transmitted to each slave computer 44*a*–44*c*, which monitors the received portion of the list 81. For example, once the list 81 is created by the route handler 52, the route handler 52 is designed to assign certain vehicles 17 to certain ones of the slave computers 44*a*–44*c*. The route handler 52 is designed to then transmit each entry defining a notification event associated with a particular vehicle 17 to the slave computer 44*a*–44*c* assigned to the particular vehicle 17. The assignment of the vehicles 17 to the slave computers 44*a*–44*c* is preferably controlled by the route handler 52 such that each slave computer 44*a*–44*c* receives a similar number of notification events in an effort to prevent any one slave computer 44*a*–44*c* from becoming overburdened.

The schedule monitor 56 in each slave computer 44*a*–44*c* then builds a notification event list 81 including each of the entries received by the slave computer 44*a*–44*c*. As a result, the functionality of monitoring the list 81 is divided across the slave computers 44*a*–44*c*. Moreover, when a status message from a VCU 15 is received by cellular interface 71, the route handler 52 in the master computer 42 is designed to determine which slave computer 44*a*–44*c* is assigned to the vehicle 17 associated with the status message. Then, the route handler 52 of the slave computer 42 is designed to transmit the status message to the slave computer 44*a*–44*c* assigned to the foregoing vehicle 17. The schedule monitor 56 in the slave computer 44*a*–44*a* receiving the status message then updates the list 81 maintained in the slave computer 44*a*–44*c*, via techniques described hereinbefore.

The schedule monitor 56 in each slave computer 44*a*–44*c* monitors the list 81 in the same slave computer 44*a*–44*c* to determine when a notification event should occur. When a notification event occurs, the schedule monitor 56 transmits a notification request to the communication handler 92, which processes the notification as described hereinbefore. Therefore, the operation of the foregoing embodiment is similar to the embodiment previously described, except that at least some of the functionality of the schedule monitor 56 is implemented in each of the slave computers 44*a*–44*c*. Dividing the functionality of the schedule monitor 56 across multiple slave computers 44*a*–44*c* is advantageous in applications utilizing a relatively large number of notification events, since monitoring of a large number of notification events by the master computer 42 may overload the master computer 42.

Operation

The preferred use and operation of the system 10 and associated methodology are described hereafter.

Initially, a vehicle schedule 39 is respectively stored in the VCU 15 of each vehicle 17 associated with the system 10. As set forth hereinbefore, the vehicle schedule 39 includes data defining a plurality of checkpoints along the vehicle's route or routes of travel and the expected time that the vehicle 17 is to pass each of the checkpoints. There are a variety of methodologies that may be employed to determine the information stored in the VCU 15. In one embodiment, the data is accumulated from the sensor 18 and the vehicle clock 38, as the vehicle 17 travels the route or routes. Such a methodology is described in more detail in U.S. patent application entitled "Apparatus and Method for Monitoring Travel of a Mobile Vehicle," assigned Ser. No. 09/395,497, and filed on Sep. 14, 1999, which is incorporated herein by reference.

The route data stored in vehicle schedule 39 is also stored in database 74 of BSCU 40. Furthermore, contact information associated with each user that is to be notified of an impending arrival of one of the vehicles 17 is also stored in database 74 so that the users may be sent a notification message at appropriate times. Each user is allowed to select a vehicle 17 and a time when the user would like to be warned of an impending arrival of the selected vehicle 17. The process of enabling a user to select a vehicle and a time is further described in U.S. patent application entitled "System and Method for Activation of an Advance Notification System for Monitoring and Reporting Status of Vehicle Travel," assigned Ser. No. 09/163,588, and filed on Sep. 30, 1998, which is incorporated herein by reference.

Figure 9:
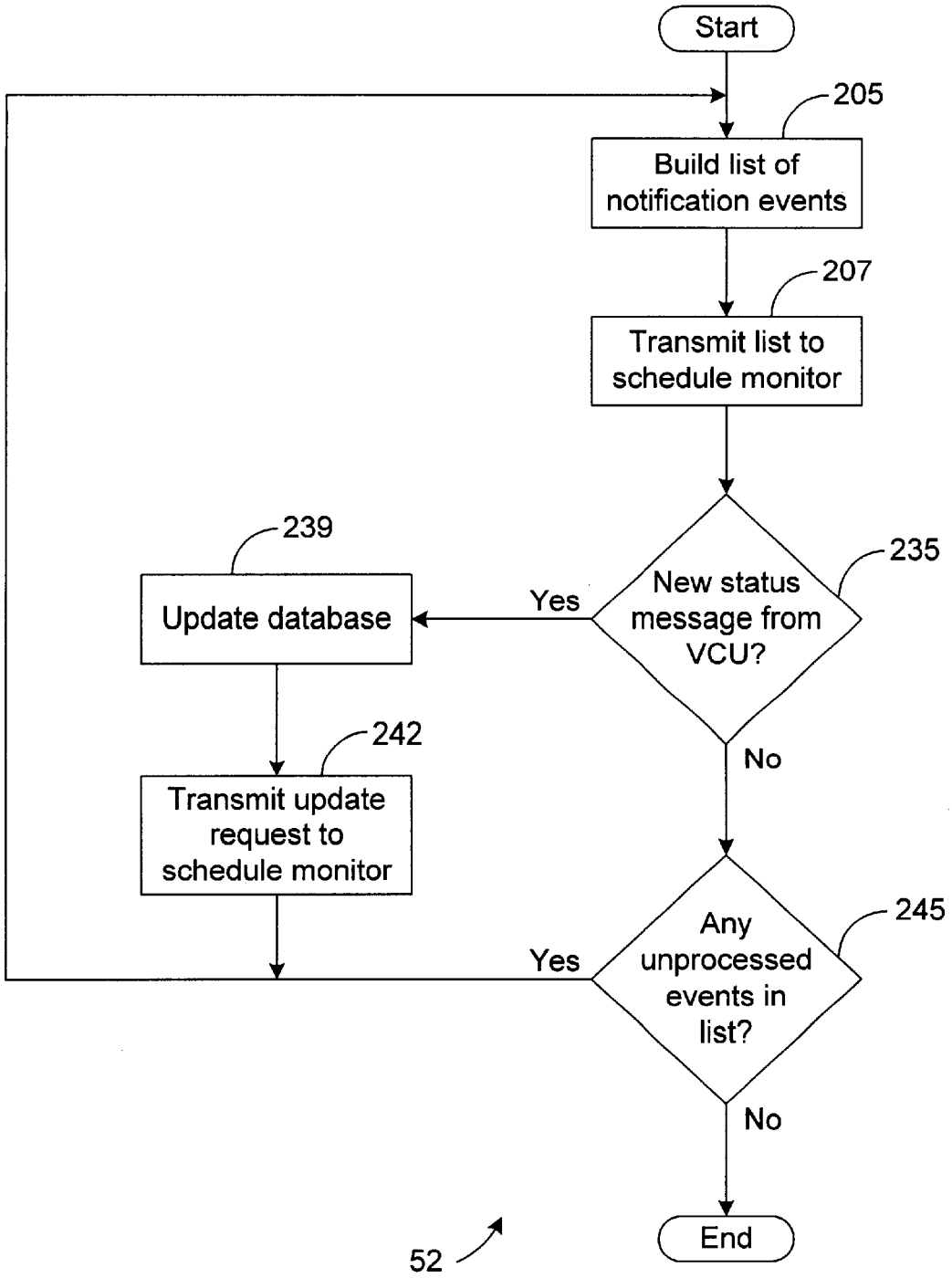
FIG. 9 is a flow chart illustrating the architecture, functionality, and operation of the route handler of FIG. 5.

As shown by blocks 205 and 207 of FIG. 9, the route handler 52 builds a list 81 of notification events that should occur during a specified time period and transmits this list 81 to schedule monitor 56. For illustrative purposes, assume that the user selects to receive a notification message when a particular vehicle 17 is five minutes from a particular location. Further assume that the vehicle 17 is scheduled to arrive at the particular location at 6:35 a.m., which is within the aforementioned specified time period. As a result, the user should receive a notification message at 6:30 a.m., if the vehicle 17 is on schedule when traveling the route, and in performing block 205, the route handler 52 defines an entry in the list 81 indicating that the user should be so notified at 6:30 a.m. "Entry 1" of the list 81 depicted by FIG. 6 is suitable for implementing the present invention in the context of the foregoing example.

Figure 10:
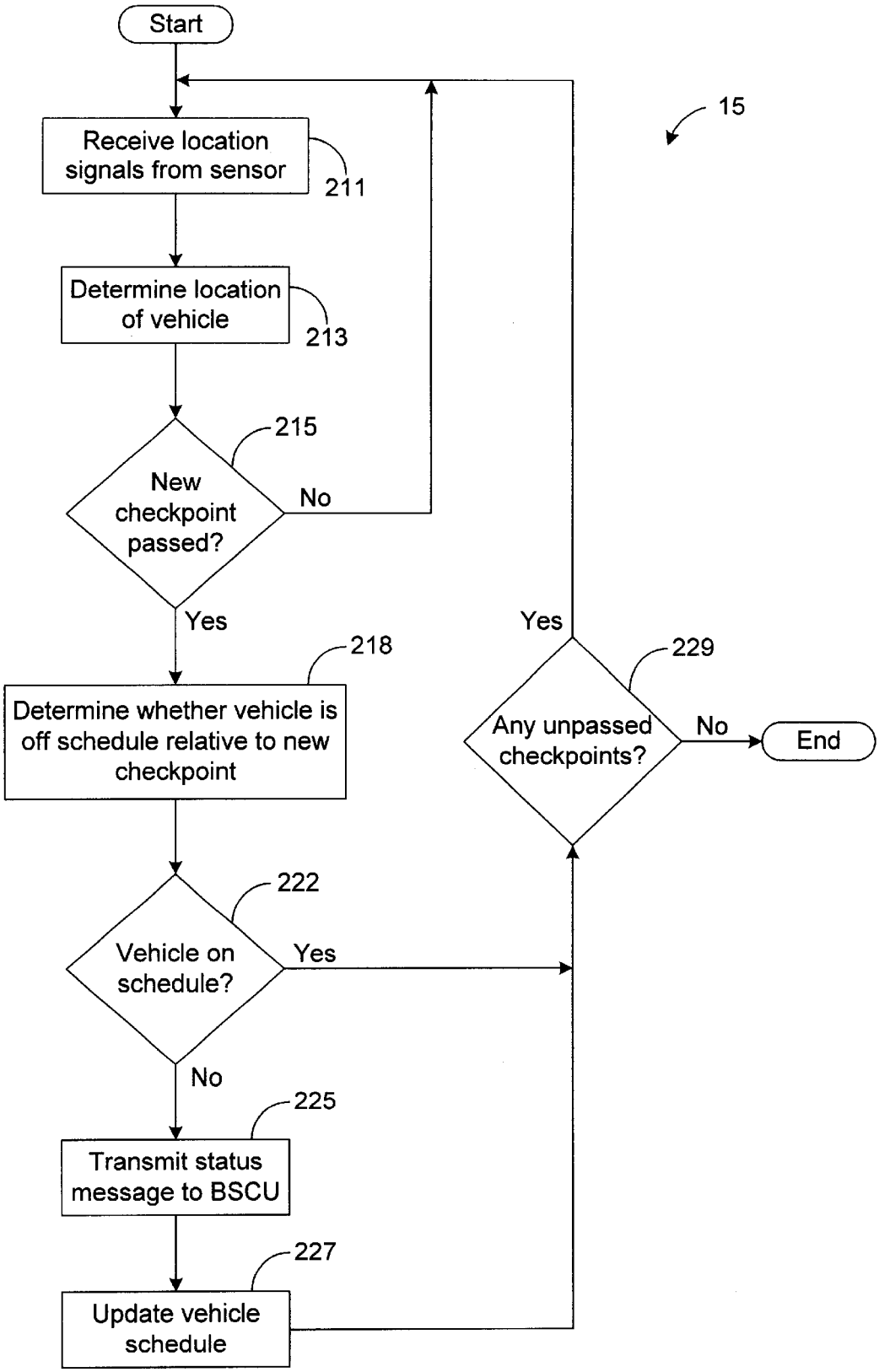
FIG. 10 is a flow chart illustrating the architecture, functionality, and operation of the vehicle control unit of FIG. 2 while the vehicle control unit is tracking the vehicle of FIG. 1.

At some point, the vehicle 17 begins to travel its route. Before or during travel of the route, the vehicle clock 38 should be synchronized with the BSCU clock 70. As vehicle 17 travels its route, it passes checkpoints, and its VCU 15 monitors its progress. In this regard, based on the signals provided by sensor 18, the VCU 15 determines when vehicle 17 passes each of its checkpoints, as shown by blocks 211, 213, and 215 of FIG. 10. As depicted by blocks 218 and 222, when vehicle 17 passes a checkpoint, the VCU 15 determines whether the vehicle 17 is on or off schedule by comparing the current time, as defined by vehicle clock 38, with the time value associated with the passed checkpoint and stored in vehicle schedule 39.

If vehicle 17 is determined to be off schedule, then the VCU 15 transmits a status message to BSCU 40 indicating how much the vehicle 17 is off schedule and updates the time values associated with the remaining checkpoints (i.e., the checkpoints that have yet to be passed by vehicle 17), as shown by blocks 225 and 227. As depicted by block 229, the VCU 15 continues to monitor the progress of vehicle 17 until vehicle 17 passes the last checkpoint on the route.

Upon receiving a status message from the VCU 15, the route handler 52 updates the database 74 to indicate that the vehicle 17 is off schedule by an amount indicated by the status message, as depicted by blocks 235 and 239 of FIG. 9. Next, as shown by block 242, the route handler 52 transmits an update request to the schedule monitor 56 indicating that the vehicle 17 associated with the status message is off schedule by a specified amount (e.g., a specified number of minutes early or late). As shown by block 245, the route handler 52 continues to check for status messages until each notification event in the list 81 has occurred.

Figure 11:
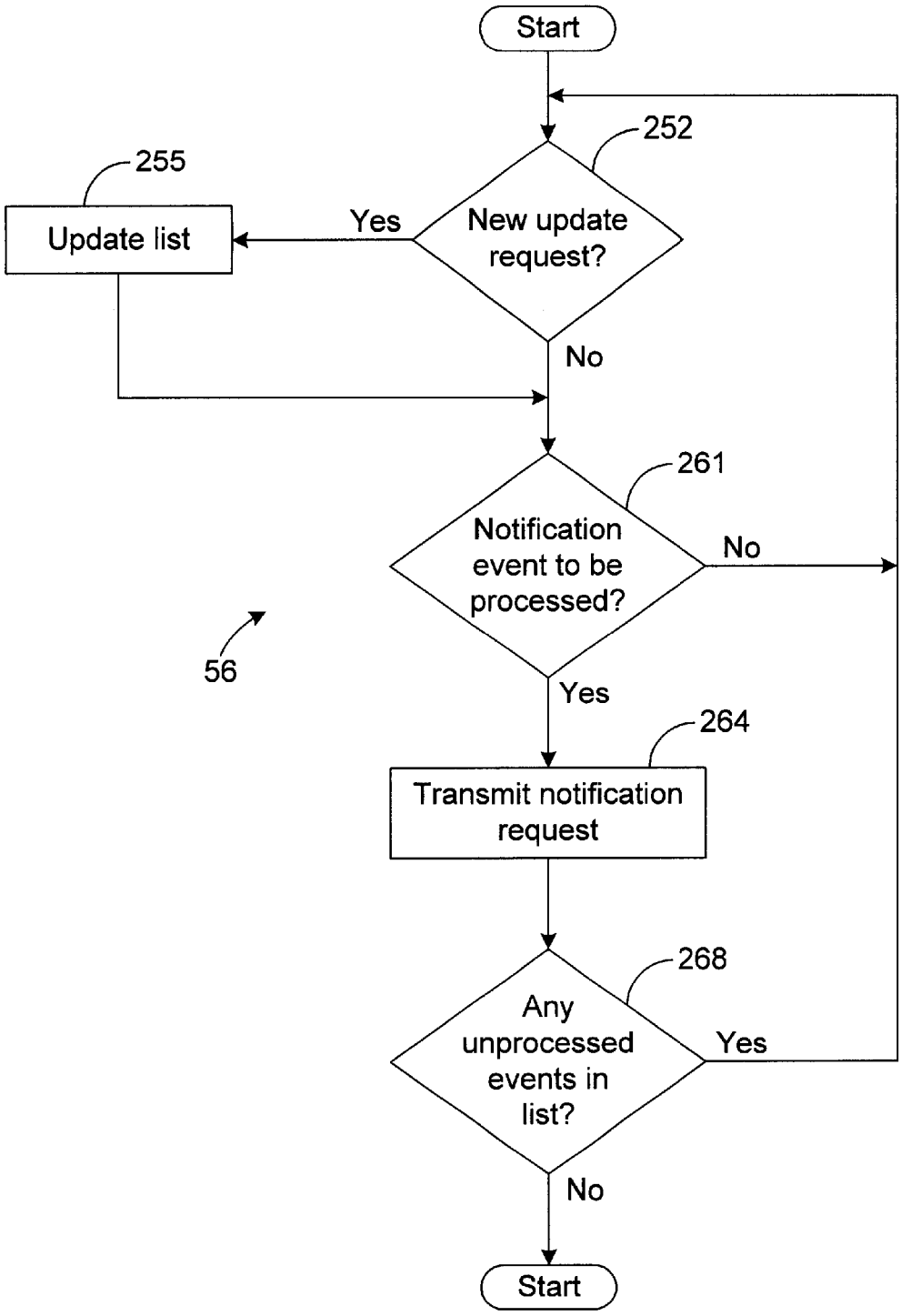
FIG. 11 is a flow chart illustrating the architecture, functionality, and operation of the communication handler of FIG. 5.

As shown by blocks 252 and 255 of FIG. 11, the schedule monitor 56 updates the list 81 when the schedule monitor 56 receives an update request from route handler 52. In this regard, when the schedule monitor 56 receives an update request indicating that a vehicle 17 is off schedule, the schedule monitor 56 changes the time values in the entries associated with the vehicle 17 by an amount that the vehicle 17 is off schedule.

As depicted by block 261, the schedule monitor 56 periodically checks to determine whether any notification events should occur. In this regard, the schedule monitor 56 compares the current time, as determined by the BSCU clock 70, with the time values in the list 81. If the time value of an entry in the list 81 corresponds with the current time (e.g., matches the current time, in the preferred embodiment), then the schedule monitor 56 determines that a notification message should be transmitted to a user to warn the user of an impending arrival of the vehicle 17 associated with the entry. Therefore, in block 264, the schedule monitor 56 transmits a notification request to one of the communication handlers 92 indicating that a user should be notified. The notification request preferably includes data identifying the user (such as the user's telephone number, pager number, e-mail address, or any other value unique to the user) and identifying the vehicle 17 associated with the notification event. As shown by block 268, the schedule monitor 56 continues to monitor the entries in the list 81 until each notification event defined by the entries has occurred.

Figure 12:
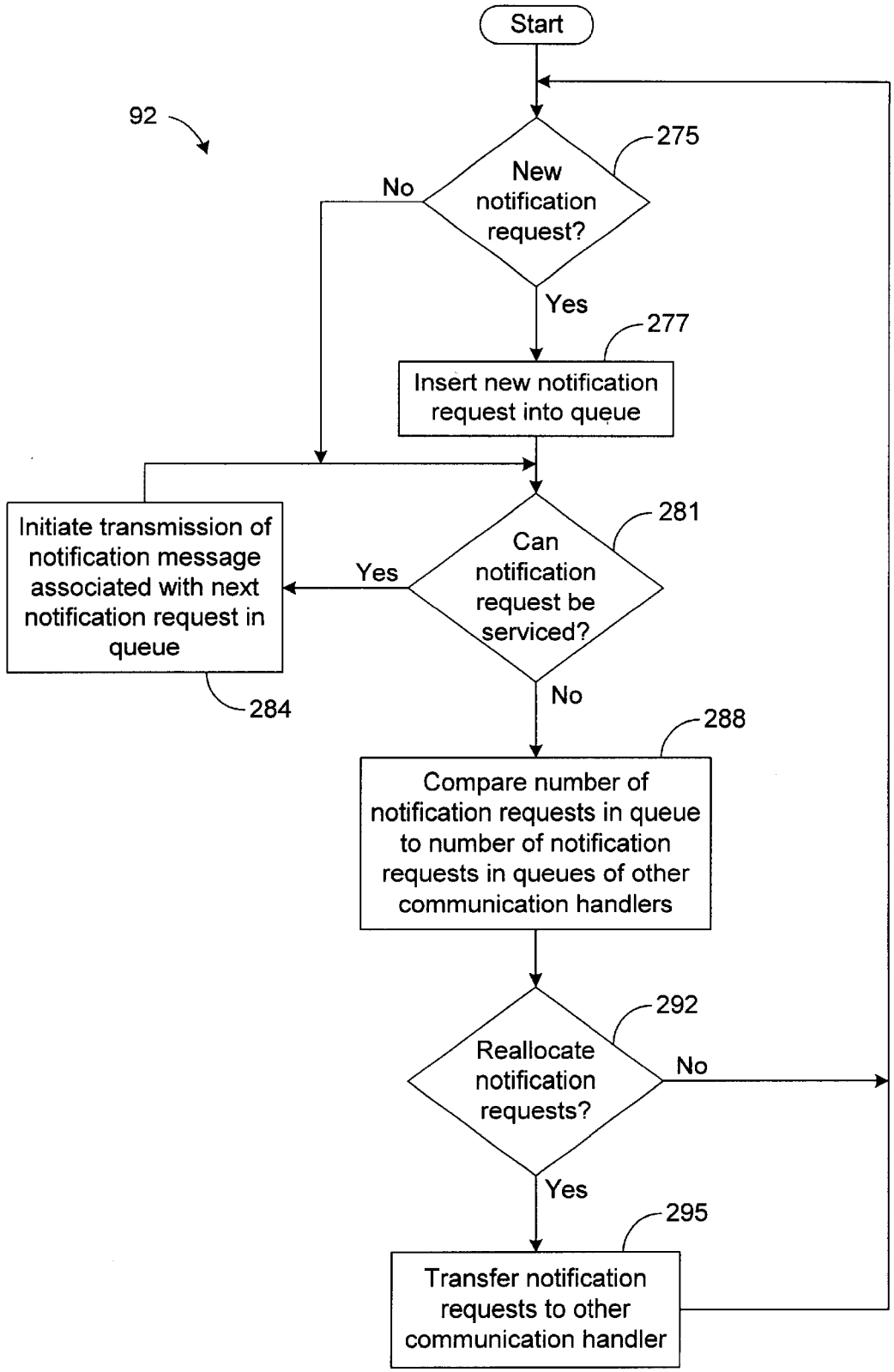
FIG. 12 is a flow chart illustrating the architecture, functionality, and operation of the communication handler of FIG. 7.

As shown by blocks 275 and 277 of FIG. 12, each communication handler 92 places any new notification request received from schedule monitor 56 into a respective queue. As depicted by blocks 281 and 284, each communication handler 92 determines whether a new call can be initiated via interface 115 and initiates transmission of a notification message if the interface 115 can handle a new call. In this regard, the communication handler 92 uses the information in the notification request to identify the user that should be notified by the notification message. The information in the notification request may either include the contact information needed to establish communication with the user or the communication handler 92 may look up the contact information in the database 74.

Furthermore, the notification message may provide a status report for the vehicle 17 associated with the notification request. For example, the notification message may indicate that the vehicle 17 is a certain number of minutes from a particular location. The communication handler 92 may retrieve information from the database 74 to form the notification message. By retrieving the information for the status report directly from the database 74, the communication handler 92 utilizes the most recent information available in providing any status reports to the user.

If the interface 115 cannot handle a new call (e.g., the interface 115 is not operating properly or there are no available communication lines 119) the communication handler 92 preferably checks to see if another communication handler 92 has a disproportionately less number of notification requests queued, as shown by block 288. If the difference in the number of queued notification requests in the two communication handlers 92 being compared in block 288 exceeds a predetermined threshold, then the communication handler 92 reallocates the queued notification requests by transmitting one or more of its queued notification requests to the other communication handler 92 that has a smaller number of queued notification requests, as depicted by blocks 292 and 295. Ultimately, a notification message is transmitted by one of the communication handlers for each notification request transmitted by the schedule monitor 56.

It should be noted that the present invention has been described herein as determining when to initiate a notification message to a user based on a time value. However, other types of values may be used to monitor the travel of the vehicle 17. For example, a notification message could be initiated when a particular vehicle comes within a certain distance of a particular location. U.S. patent application entitled "Base Station Apparatus and Method for Monitoring Travel of a Mobile Vehicle," assigned Ser. No. 09/395,501, and filed on Sep. 14, 1999, which is incorporated herein be reference, describes how distance values may be used to determine when to transmit notification messages.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention and protected by the claims.

Now, therefore, the following is claimed:

1. A system for notifying users of impending arrivals of vehicles at particular locations, comprising:

memory storing a first time value, said first time value indicating when a user should be notified of an impending arrival of a vehicle;

a clock configured to produce a second time value;

a route handler configured to receive a status message from said vehicle and to transmit an update request when said vehicle is off schedule based on said status message;

a schedule monitor configured to compare said first time value to said second time value and to produce and transmit a notification request based on a comparison of said time values, said schedule monitor further configured to update said first time value in response to said update request; and a communication handler configured to receive said notification request and to transmit a notification message to said user in response to said notification request, said communication handler further configured to store said notification request and to determine a number of notification requests stored by said communication handler, said communication handler further configured to compare said number of notification requests to a threshold number and to cause reallocation of notification requests between said communication handler and at least one other communication handler based on a comparison of said number of notification requests to said threshold number.

2. The system of claim 1, wherein said communication handler receives a notification request in response to said reallocation.

3. The system of claim 1, wherein said communication handler transmits a notification request in response to said reallocation.

4. The system of claim 1, wherein said threshold number is a number of notification requests stored in another communication handler.

5. The system of claim 1, wherein said communication handler is configured to simultaneously transmit a plurality of notification messages across a plurality of communication lines.

6. The system of claim 1, further comprising:

a database storing route information associated with a plurality of vehicles, said route information including said first time value, wherein said route handler is configured to determine whether said first time value is associated with a notification event that is expected to occur within a particular time period and to transmit said first time value to said schedule monitor in response to a determination that said notification event associated with said first time value is expected to occur within said particular time period.

7. The system of claim 1, wherein said route handler is further configured to produce a list of notification events that are expected to occur within a particular time period, said route handler further configured to include said first time value in said list in response to a determination that said first time value is associated with a notification event that is expected to occur within said particular time period, said schedule monitor further configured to analyze said list to determine whether any notification requests should be transmitted to said communication handler.

8. The system of claim 1, wherein said schedule monitor is implemented within a first computer system and said communication handler is implemented within a second computer system.

9. A system for notifying users of impending arrivals of vehicles at particular locations, comprising:

a database storing data associated with a plurality of vehicles;

a route handler configured to analyze said data and to select portions of said data that are associated with notification events expected to occur during a particular time period;

a schedule monitor configured to analyze said selected portions of said data during said particular time period and to disregard other portions of said data during said particular time period, said schedule monitor further configured to determine when at least one of said notification events should occur based on said selected portions of said data and to transmit a notification request in response to a determination by said schedule monitor that said at least one notification event should occur; and a communication handler configured to receive said notification request and to transmit a notification message in response to said notification request.

10. The system of claim 9, wherein said communication handler is configured to simultaneously transmit a plurality of notification messages across a plurality of communication lines.

11. The system of claim 9, wherein said communication handler is configured to store said notification request and to determine a number of notification requests stored by said communication handler, said communication handler further configured to compare said number of notification requests to a threshold number and to cause reallocation of notification requests between said communication handler and at least one other communication handler based on a comparison of said number of notification requests to said threshold number.

12. The system of claim 9, wherein said schedule monitor is implemented in a first computer system and said communication handler is implemented in a second computer system.

13. A system for notifying users of impending arrivals of vehicles at particular locations, comprising:

memory storing data indicating a proximity of at least one vehicle to at least one location;

a route handler configured to receive status messages and to update said data based on said status messages;

a schedule monitor configured to monitor said data and to transmit notification requests in response to determinations by said schedule monitor that said at least one vehicle is within a predefined proximity of at least one location; and a plurality of communication handlers configured to respectively receive said notification requests and to transmit notification messages in response to said notification requests, wherein said schedule monitor is further configured to determine a number of notification requests transmitted to one of said communication handlers within a first particular time period and to allocate said notification requests between said communication handlers based on said number.

14. The system of claim 13, wherein at least one of said communication handlers is configured to store notification requests and to determine a number of notification requests stored by said at least one communication handler, said at least one communication handler further configured to compare said number of notification requests to a threshold number and to cause reallocation of notification requests between said communication handler and another of said communications handlers based on a comparison of said number of notification requests to said threshold number.

15. The system of claim 13, wherein said route handler selects said data in response to a determination by said route handler that said data is associated with notification events that are expected to occur during a second particular time period.

16. A method for notifying users of impending arrivals of vehicles at particular locations, comprising the steps of:

storing a first time value, said first time value indicating when a user should be notified of an impending arrival of a vehicle;

receiving a second time value;

receiving a status message transmitted from said vehicle;

updating said first time value based on said status message;

comparing said first time value to said second time value;

transmitting a notification request to a communication handler based on said comparing said first time value step;

determining a number of notification requests stored by a communication handler;

comparing said number of notification requests to a threshold number;

reallocating said notification request between said communication handlers based on said comparing said number of notification requests step; and transmitting a notification message to said user in response to said notification request.

17. The method of claim 16, further comprising the steps of:

determining whether said first time value indicates a time within a particular time period, said particular time period including a time indicated by said second time value; and performing said comparing said first time value step during said particular time period in response to a determination in said determining step that said first time value indicates a time within said particular time period.

18. The method of claim 16, further comprising the steps of:

creating a list of notification events that are expected to occur within a particular time period;

including said first time value in said list in response to a determination that said first time value is associated with a notification event that is expected to occur within said particular time period; and monitoring said list during said particular time period, said monitoring step including said comparing said first time value step.

19. A method for notifying users of impending arrivals of vehicles at particular locations, comprising the steps of:

storing data associated with a plurality of vehicles;

selecting portions of said data that are associated with notification events expected to occur during a particular time period;

analyzing said selected portions of said data during said particular time period;

disregarding other portions of said data during said particular time period;

determining when at least one of said notification events should occur based on said analyzing step; and transmitting a notification message in response to said determining step.

20. A method for notifying users of impending arrivals of vehicles at particular locations, comprising the steps of:

storing data associated with at least one vehicle;

receiving at least one status message from said one vehicle;

updating said data based on said one status message;

analyzing said data;

determining when to notify a user of an impending arrival of said one vehicle at a particular location based on said analyzing step;

transmitting a notification request based on said determining step; and allocating said notification request to a communication handler based on a number of notification requests transmitted to said communication handler during a first particular time period.

21. The method of claim 20, further comprising the step of transmitting a notification message from said communication handler in response to said notification request, said notification message indicating said impending arrival of said one vehicle.

22. The method of claim 20, further comprising the steps of:

storing said notification request in said communication handler;

determining a number of notification requests stored in said communication handler;

comparing said number of notification requests to a threshold number;

transmitting said notification request to another handler based on said comparing step; and transmitting a notification message from said other communication handler in response to said notification request, said notification message indicating said impending arrival of said one vehicles.

23. The method of claim 20, further comprising the step of selecting said data in response to a determination that said data is associated with notification events that are expected to occur during a second particular time period.

* * * * *